US009080515B2

(12) United States Patent
Kar et al.

(10) Patent No.: US 9,080,515 B2
(45) Date of Patent: Jul. 14, 2015

(54) SYSTEM AND METHOD FOR CONTROLLING ENGINE TORQUE TO PREVENT DRIVELINE BUMP WHEN A DRIVER DEPRESSES AN ACCELERATOR PEDAL

(75) Inventors: Krishnendu Kar, South Lyon, MI (US); Bret J. Keller, Livonia, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 391 days.

(21) Appl. No.: 13/605,270

(22) Filed: Sep. 6, 2012

(65) Prior Publication Data

US 2013/0325291 A1 Dec. 5, 2013

Related U.S. Application Data

(60) Provisional application No. 61/652,605, filed on May 29, 2012.

(51) Int. Cl.

| | |
|---|---|
| ***F02D 28/00*** | (2006.01) |
| ***F02D 9/10*** | (2006.01) |
| ***F02D 41/10*** | (2006.01) |

(52) U.S. Cl.

CPC ..... *F02D 9/10* (2013.01); *F02D 41/107* (2013.01); *F02D 2250/21* (2013.01); *F02D 2250/26* (2013.01)

(58) Field of Classification Search

CPC ..... F02D 17/02; F02D 41/042; F02D 41/123; F02N 11/0855; B60W 2500/04; Y02T 10/48

USPC ..... 701/102, 107, 110, 112, 114; 123/179.3, 179.4, 349–352, 361, 395, 123/399, 339.1, 339.15, 339.19, 198 D, 123/559.1, 559.3

See application file for complete search history.

(56) References Cited

U.S. PATENT DOCUMENTS

| | | | | |
|---|---|---|---|---|
| 7,058,502 | B2 * | 6/2006 | Rodgers | 701/104 |
| 2002/0129788 | A1 * | 9/2002 | O'Neil et al. | 123/350 |
| 2005/0016162 | A1 * | 1/2005 | Mehta et al. | 60/285 |
| 2005/0137059 | A1 * | 6/2005 | Takahashi | 477/169 |
| 2009/0056672 | A1 * | 3/2009 | Whitney et al. | 123/395 |
| 2009/0101101 | A1 * | 4/2009 | Iwamoto | 123/198 C |
| 2011/0168117 | A1 * | 7/2011 | Bolander et al. | 123/179.3 |
| 2011/0238280 | A1 * | 9/2011 | Shibata et al. | 701/102 |
| 2012/0078486 | A1 * | 3/2012 | Welschof et al. | 701/102 |
| 2012/0145123 | A1 * | 6/2012 | Ono | 123/339.11 |
| 2012/0180759 | A1 * | 7/2012 | Whitney et al. | 123/406.23 |
| 2012/0247411 | A1 * | 10/2012 | Stewart et al. | 123/90.17 |

* cited by examiner

*Primary Examiner* — John Kwon
*Assistant Examiner* — Johnny H Hoang

(57) ABSTRACT

A system according the principles of the present disclosure includes a torque determination module and a torque limit module. The torque determination module determines a first torque that prevents an engine from stalling. The torque limit module limits engine torque based on the first torque when a driver actuates an accelerator pedal from a first position in which the accelerator pedal is not depressed to a second position in which the accelerator pedal is depressed.

20 Claims, 5 Drawing Sheets

SYSTEM AND METHOD FOR CONTROLLING ENGINE TORQUE TO PREVENT DRIVELINE BUMP WHEN A DRIVER DEPRESSES AN ACCELERATOR PEDAL

CROSS-REFERENCE TO RELATED APPLICATIONS

This application claims the benefit of U.S. Provisional Application No. 61/652,605, filed on May 29, 2012. The disclosure of the above application is incorporated herein by reference in its entirety.

FIELD

The present disclosure relates to systems and methods for preventing driveline bump when a driver depresses an accelerator pedal.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts the throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Engine control systems have been developed to control engine output torque to achieve a desired torque. Traditional engine control systems, however, do not control the engine output torque as accurately as desired. Further, traditional engine control systems do not provide a rapid response to control signals or coordinate engine torque control among various devices that affect the engine output torque.

SUMMARY

A system according the principles of the present disclosure includes a torque determination module and a torque limit module. The torque determination module determines a first torque that prevents an engine from stalling. The torque limit module limits engine torque based on the first torque when a driver actuates an accelerator pedal from a first position in which the accelerator pedal is not depressed to a second position in which the accelerator pedal is depressed.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A manual transmission is directly and mechanically coupled to an engine. An automatic transmission is hydraulically coupled to an engine using a torque converter. Torque converters include an impeller and a turbine. The impeller is mechanically coupled to the engine. The turbine is hydraulically coupled to the impeller and is mechanically coupled to the transmission. Torque converters may also include a lock-up clutch that locks the turbine to the impeller, mechanically coupling the impeller and the turbine.

When an engine produces drive torque, gear teeth on a flywheel of the engine engage gear teeth on a clutch plate of a manual transmission or a torque converter of an automatic transmission. When a vehicle is coasting, the gear teeth on the flywheel may disengage from the gear teeth on the clutch plate, yielding slack in the driveline. When a driver then tips into an accelerator pedal (i.e., depresses an accelerator pedal from a rest position), driveline bump may occur due to slack in the driveline as the gear teeth on the flywheel initially make contact with the gear teeth on the clutch plate. With an automatic transmission, the driveline bump may also be due to a difference between engine speed and turbine speed. With a manual transmission, the driveline bump may also be due to a difference between engine speed and transmission input shaft speed.

An engine control system and method according to the principles of the present disclosure prevents driveline bump by limiting engine torque when a driver tips into an accelerator pedal. Engine torque is limited so that engine speed matches turbine speed or transmission input shaft speed when gear teeth on an engine side initially make contact with gear teeth on a transmission side. Engine torque may be limited based on a minimum torque that prevents an engine from stalling.

As engine torque is limited, the engine torque may be ramped up to a driver torque request. If this ramping is done too quickly, a driver may still feel driveline bump. If this ramping is done too slowly, a driver may notice a delay in vehicle acceleration. Thus, engine torque may be limited based on a balance between preventing driveline bump and preventing acceleration delay.

Figure 1:
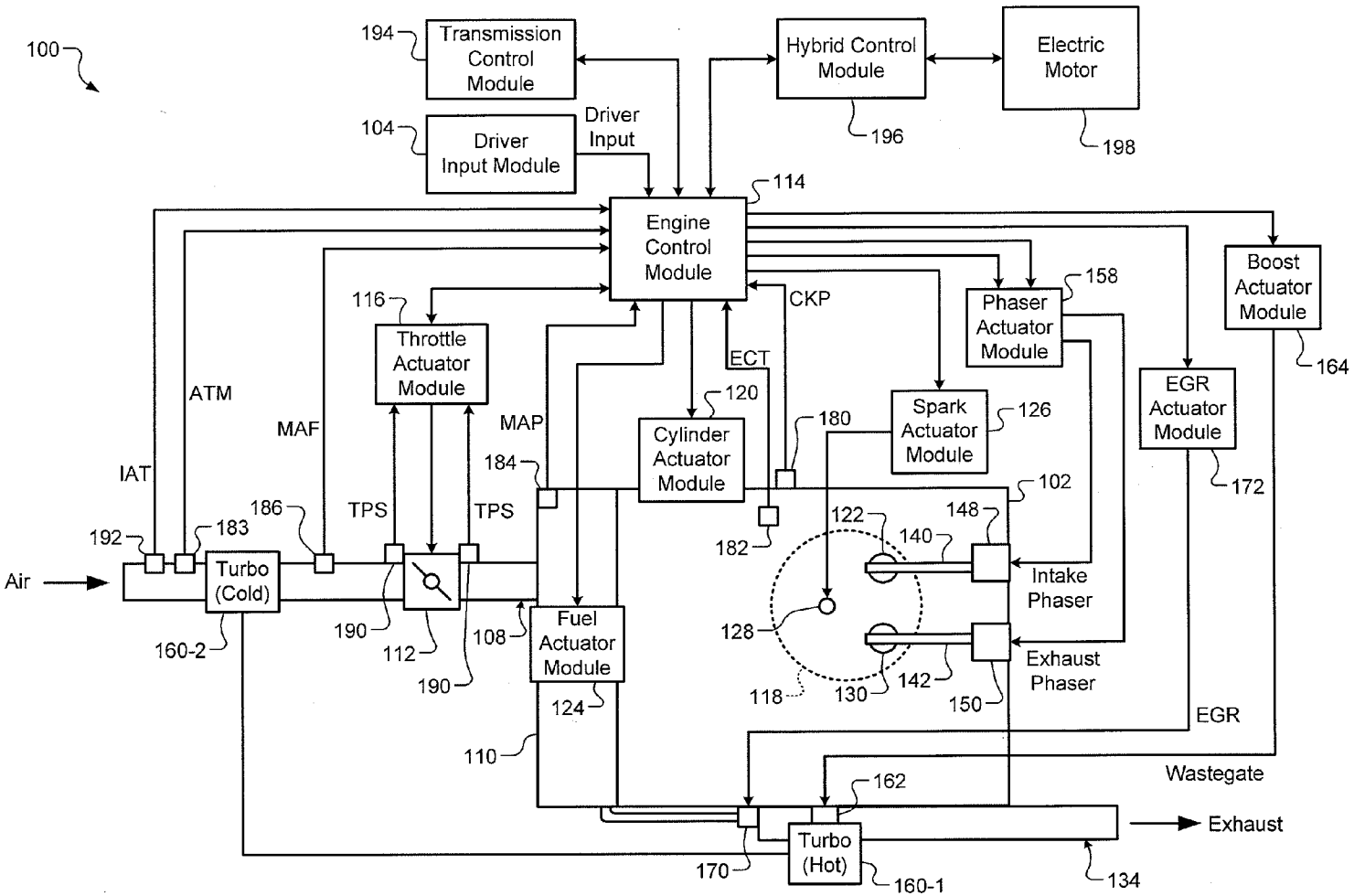
FIG. 1 is a functional block diagram of an example engine system according to the principles of the present disclosure.

Referring now to FIG. 1, a functional block diagram of an example engine system 100 is presented. The engine system 100 includes an engine 102 that combusts an air/fuel mixture to produce drive torque for a vehicle based on driver input from a driver input module 104. Air is drawn into the engine 102 through an intake system 108. For example only, the intake system 108 may include an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event.

During the combustion stroke, the combustion of the air/fuel mixture drives the piston down, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as electromagnetic actuators.

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, which compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the position of the crankshaft using a crankshaft position (CKP) sensor 180. The ECM 114 may use the crankshaft position to calculate engine speed in, for example, revolutions per minute (rpm). The temperature of the engine coolant may be measured using an engine coolant temperature (ECT) sensor 182. The ECT sensor 182 may be located within the engine 102 or at other locations where the coolant is circulated, such as a radiator (not shown).

Atmospheric pressure may be measured using an atmospheric pressure (ATM) sensor 183. The pressure within the intake manifold 110 may be measured using a manifold absolute pressure (MAP) sensor 184. In various implementations, engine vacuum, which is the difference between the ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 may communicate with a transmission control module (TCM) 194 to coordinate shifting gears in a transmission (not shown). For example, the ECM 114 may reduce engine torque during a gear shift. The ECM 114 may communicate with a hybrid control module (HCM) 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the TCM 194, and the HCM 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate, intake and exhaust cam phaser angles, boost pressure, and EGR valve opening area, respectively. The ECM 114 may control actuator values in order to cause the engine 102 to generate a desired engine output torque.

Figure 2:
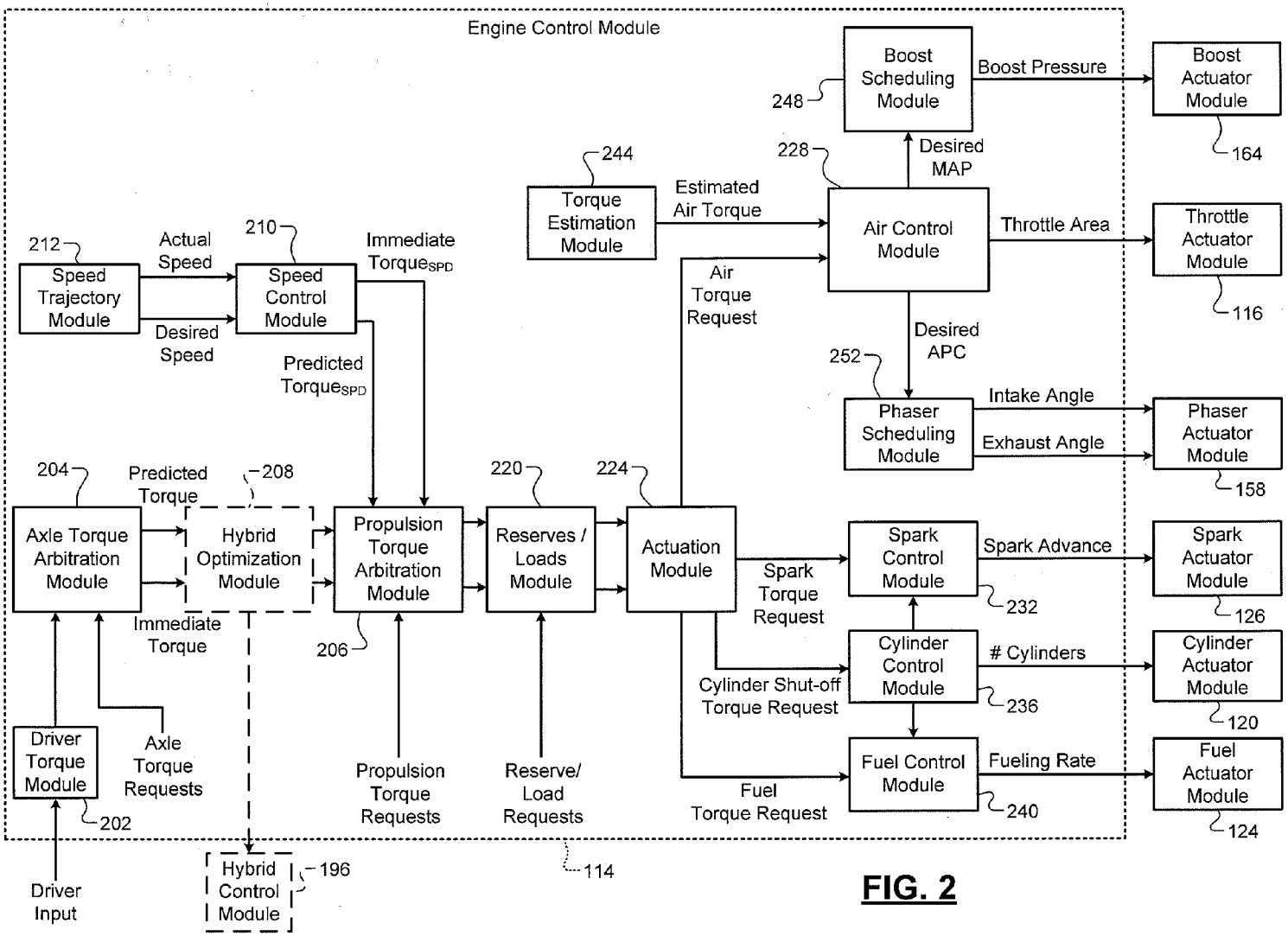
FIG. 2 is a functional block diagram of an example engine control system according to the principles of the present disclosure.

Referring now to FIG. 2, a functional block diagram of an example engine control system is presented. An example implementation of the ECM 114 includes a driver torque module 202. The driver torque module 202 may determine a driver torque request based on a driver input from the driver input module 104. The driver input may be based on a position of an accelerator pedal. The driver input may also be based on cruise control, which may be an adaptive cruise control system that varies vehicle speed to maintain a predetermined following distance. The driver torque module 202 may store one or more mappings of accelerator pedal position to desired torque, and may determine the driver torque request based on a selected one of the mappings.

An axle torque arbitration module 204 arbitrates between the driver torque request from the driver torque module 202 and other axle torque requests. Axle torque (torque at the wheels) may be produced by various sources including an engine and/or an electric motor. Torque requests may include absolute torque requests as well as relative torque requests and ramp requests. For example only, ramp requests may include a request to ramp torque down to a minimum engine off torque or to ramp torque up from the minimum engine off torque. Relative torque requests may include temporary or persistent torque reductions or increases.

Axle torque requests may include a torque reduction requested by a traction control system when positive wheel slip is detected. Positive wheel slip occurs when axle torque overcomes friction between the wheels and the road surface, and the wheels begin to slip against the road surface. Axle torque requests may also include a torque increase request to counteract negative wheel slip, where a tire of the vehicle slips with respect to the road surface because the axle torque is negative.

Axle torque requests may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. Axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules of the ECM 114 before being used to control actuators of the engine system 100.

In general terms, the immediate torque request is the amount of currently desired axle torque, while the predicted torque request is the amount of axle torque that may be needed on short notice. The ECM 114 therefore controls the engine system 100 to produce an axle torque equal to the immediate torque request. However, different combinations of actuator values may result in the same axle torque. The ECM 114 may therefore adjust the actuator values to allow a faster transition to the predicted torque request, while still maintaining the axle torque at the immediate torque request.

In various implementations, the predicted torque request may be based on the driver torque request. The immediate torque request may be less than the predicted torque request, such as when the driver torque request is causing wheel slip on an icy surface. In such a case, a traction control system (not shown) may request a reduction via the immediate torque request, and the ECM 114 reduces the torque produced by the engine system 100 to the immediate torque request. However, the ECM 114 controls the engine system 100 so that the engine system 100 can quickly resume producing the predicted torque request once the wheel slip stops.

In general terms, the difference between the immediate torque request and the higher predicted torque request can be referred to as a torque reserve. The torque reserve may represent the amount of additional torque that the engine system 100 can begin to produce with minimal delay. Fast engine actuators are used to increase or decrease current axle torque. As described in more detail below, fast engine actuators are defined in contrast with slow engine actuators.

In various implementations, fast engine actuators are capable of varying axle torque within a range, where the range is established by the slow engine actuators. In such implementations, the upper limit of the range is the predicted torque request, while the lower limit of the range is limited by the torque capacity of the fast actuators. For example only, fast actuators may only be able to reduce axle torque by a first amount, where the first amount is a measure of the torque capacity of the fast actuators. The first amount may vary based on engine operating conditions set by the slow engine actuators. When the immediate torque request is within the range, fast engine actuators can be set to cause the axle torque to be equal to the immediate torque request. When the ECM 114 requests the predicted torque request to be output, the fast engine actuators can be controlled to vary the axle torque to the top of the range, which is the predicted torque request.

In general terms, fast engine actuators can more quickly change the axle torque when compared to slow engine actuators. Slow actuators may respond more slowly to changes in their respective actuator values than fast actuators do. For example, a slow actuator may include mechanical components that require time to move from one position to another in response to a change in actuator value. A slow actuator may also be characterized by the amount of time it takes for the axle torque to begin to change once the slow actuator begins to implement the changed actuator value. Generally, this amount of time will be longer for slow actuators than for fast actuators. In addition, even after beginning to change, the axle torque may take longer to fully respond to a change in a slow actuator.

For example only, the ECM 114 may set actuator values for slow actuators to values that would enable the engine system 100 to produce the predicted torque request if the fast actuators were set to appropriate values. Meanwhile, the ECM 114 may set actuator values for fast actuators to values that, given the slow actuator values, cause the engine system 100 to produce the immediate torque request instead of the predicted torque request.

The fast actuator values therefore cause the engine system 100 to produce the immediate torque request. When the ECM 114 decides to transition the axle torque from the immediate torque request to the predicted torque request, the ECM 114 changes the actuator values for one or more fast actuators to values that correspond to the predicted torque request. Because the slow actuator values have already been set based on the predicted torque request, the engine system 100 is able to produce the predicted torque request after only the delay imposed by the fast actuators. In other words, the longer delay that would otherwise result from changing axle torque using slow actuators is avoided.

For example only, when the predicted torque request is equal to the driver torque request, a torque reserve may be created when the immediate torque request is less than the driver torque request due to a temporary torque reduction request. Alternatively, a torque reserve may be created by increasing the predicted torque request above the driver torque request while maintaining the immediate torque request at the driver torque request. The resulting torque reserve can absorb sudden increases in required axle torque. For example only, sudden loads from an air conditioner or a power steering pump may be counterbalanced by increasing the immediate torque request. If the increase in immediate torque request is less than the torque reserve, the increase can be quickly produced by using fast actuators. The predicted torque request may then also be increased to re-establish the previous torque reserve.

Another example use of a torque reserve is to reduce fluctuations in slow actuator values. Because of their relatively slow speed, varying slow actuator values may produce control instability. In addition, slow actuators may include mechanical parts, which may draw more power and/or wear more quickly when moved frequently. Creating a sufficient torque reserve allows changes in desired torque to be made by varying fast actuators via the immediate torque request while maintaining the values of the slow actuators. For example, to maintain a given idle speed, the immediate torque request may vary within a range. If the predicted torque request is set to a level above this range, variations in the immediate torque request that maintain the idle speed can be made using fast actuators without the need to adjust slow actuators.

For example only, in a spark-ignition engine, spark timing may be a fast actuator value, while throttle opening area may be a slow actuator value. Spark-ignition engines may combust fuels including, for example, gasoline and ethanol, by applying a spark. By contrast, in a compression-ignition engine, fuel flow may be a fast actuator value, while throttle opening area may be used as an actuator value for engine characteristics other than torque. Compression-ignition engines may combust fuels including, for example, diesel, by compressing the fuels.

When the engine 102 is a spark-ignition engine, the spark actuator module 126 may be a fast actuator and the throttle actuator module 116 may be a slow actuator. After receiving a new actuator value, the spark actuator module 126 may be able to change spark timing for the following firing event. When the spark timing (also called spark advance) for a firing event is set to a calibrated value, maximum torque is produced in the combustion stroke immediately following the firing event. However, a spark advance deviating from the calibrated value may reduce the amount of torque produced in the combustion stroke. Therefore, the spark actuator module 126 may be able to vary engine output torque as soon as the next firing event occurs by varying spark advance. For example only, a table of spark advances corresponding to different engine operating conditions may be determined during a calibration phase of vehicle design, and the calibrated value is selected from the table based on current engine operating conditions.

By contrast, changes in throttle opening area take longer to affect engine output torque. The throttle actuator module 116 changes the throttle opening area by adjusting the angle of the blade of the throttle valve 112. Therefore, once a new actuator value is received, there is a mechanical delay as the throttle valve 112 moves from its previous position to a new position based on the new actuator value. In addition, air flow changes based on the throttle valve opening are subject to air transport delays in the intake manifold 110. Further, increased air flow in the intake manifold 110 is not realized as an increase in engine output torque until the cylinder 118 receives additional air in the next intake stroke, compresses the additional air, and commences the combustion stroke.

Using these actuators as an example, a torque reserve can be created by setting the throttle opening area to a value that would allow the engine 102 to produce a predicted torque request. Meanwhile, the spark timing can be set based on an immediate torque request that is less than the predicted torque request. Although the throttle opening area generates enough air flow for the engine 102 to produce the predicted torque request, the spark timing is retarded (which reduces torque)

based on the immediate torque request. The engine output torque will therefore be equal to the immediate torque request.

When additional torque is needed, such as when the air conditioning compressor is started, or when traction control determines wheel slip has ended, the spark timing can be set based on the predicted torque request. By the following firing event, the spark actuator module 126 may return the spark advance to a calibrated value, which allows the engine 102 to produce the full engine output torque achievable with the air flow already present. The engine output torque may therefore be quickly increased to the predicted torque request without experiencing delays from changing the throttle opening area.

When the engine 102 is a compression-ignition engine, the fuel actuator module 124 may be a fast actuator and the throttle actuator module 116 and the boost actuator module 164 may be emissions actuators. In this manner, the fuel mass may be set based on the immediate torque request, and the throttle opening area and boost may be set based on the predicted torque request. The throttle opening area may generate more air flow than necessary to satisfy the predicted torque request. In turn, the air flow generated may be more than required for complete combustion of the injected fuel such that the air/fuel ratio is usually lean and changes in air flow do not affect the engine torque output. The engine output torque will therefore be equal to the immediate torque request and may be increased or decreased by adjusting the fuel flow.

The throttle actuator module 116, the boost actuator module 164, and the EGR actuator module 172 may be controlled based on the predicted torque request to control emissions and to minimize turbo lag. The throttle actuator module 116 may create a vacuum to draw exhaust gases through the EGR valve 170 and into the intake manifold 110.

The axle torque arbitration module 204 may output the predicted torque request and the immediate torque request to a propulsion torque arbitration module 206. In various implementations, the axle torque arbitration module 204 may output the predicted and immediate torque requests to a hybrid optimization module 208. The hybrid optimization module 208 determines how much torque should be produced by the engine 102 and how much torque should be produced by the electric motor 198. The hybrid optimization module 208 then outputs modified predicted and immediate torque requests to the propulsion torque arbitration module 206. In various implementations, the hybrid optimization module 208 may be implemented in the HCM 196.

The predicted and immediate torque requests received by the propulsion torque arbitration module 206 are converted from an axle torque domain (torque at the wheels) into a propulsion torque domain (torque at the crankshaft). This conversion may occur before, after, as part of, or in place of the hybrid optimization module 208.

The propulsion torque arbitration module 206 arbitrates between propulsion torque requests, including the converted predicted and immediate torque requests. The propulsion torque arbitration module 206 generates an arbitrated predicted torque request and an arbitrated immediate torque request. The arbitrated torques may be generated by selecting a winning request from among received requests. Alternatively or additionally, the arbitrated torques may be generated by modifying one of the received requests based on another one or more of the received requests.

Other propulsion torque requests may include torque reductions for engine over-speed protection, torque increases for stall prevention, and torque reductions requested by the TCM 194 to accommodate gear shifts. Propulsion torque requests may also result from clutch fuel cutoff, which reduces the engine output torque when the driver depresses the clutch pedal in a manual transmission vehicle to prevent a flare (rapid rise) in engine speed.

Propulsion torque requests may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 206 may output zero as the arbitrated torques.

In various implementations, an engine shutoff request may simply shut down the engine 102 separately from the arbitration process. The propulsion torque arbitration module 206 may still receive the engine shutoff request so that, for example, appropriate data can be fed back to other torque requestors. For example, all other torque requestors may be informed that they have lost arbitration.

A speed control module 210 may also output predicted and immediate torque requests to the propulsion torque arbitration module 206. The torque requests from the speed control module 210 may prevail in arbitration when the ECM 114 is in a speed mode. Speed mode may be enabled when the driver removes their foot from the accelerator pedal, such as when the engine 102 is idling or when the vehicle is coasting down from a higher speed. Alternatively or additionally, speed mode may be enabled when the predicted torque request from the axle torque arbitration module 204 is less than a predetermined torque value.

The speed control module 210 receives an actual speed and a desired speed from a speed trajectory module 212 and controls the predicted and immediate torque requests to reduce the difference between the actual speed and the desired speed. For example only, the speed trajectory module 212 may output a linearly decreasing desired speed for vehicle coastdown until an idle speed is reached. The speed trajectory module 212 may then continue outputting the idle speed as the desired speed. In the preceding example, the linearly decreasing desired speed may be referred to as a reference speed and the idle speed may be referred to as the desired speed. The speed control module 210 may receive both the reference speed and the desired speed from the speed trajectory module 212.

A reserves/loads module 220 receives the arbitrated predicted and immediate torque requests from the propulsion torque arbitration module 206. The reserves/loads module 220 may adjust the arbitrated predicted and immediate torque requests to create a torque reserve and/or to compensate for one or more loads. The reserves/loads module 220 then outputs the adjusted predicted and immediate torque requests to an actuation module 224. The actuation module 224 may be referred to as a torque control module.

For example only, a catalyst light-off process or a cold start emissions reduction process may require retarded spark advance. The reserves/loads module 220 may therefore increase the adjusted predicted torque request above the adjusted immediate torque request to create retarded spark for the cold start emissions reduction process. In another example, the air/fuel ratio of the engine and/or the mass air flow may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The reserves/loads module 220 may also create or increase a torque reserve in anticipation of a future load, such as power steering pump operation or engagement of an air conditioning (NC) compressor clutch. The reserve for engagement of the A/C compressor clutch may be created when the driver first requests air conditioning. The reserves/loads module 220 may increase the adjusted predicted torque request while leaving the adjusted immediate torque request unchanged to produce the torque reserve. Then, when the A/C compressor clutch engages, the reserves/loads module 220 may increase the immediate torque request by the estimated load of the A/C compressor clutch.

The actuation module 224 receives the adjusted predicted and immediate torque requests from the reserves/loads module 220. The actuation module 224 determines how the adjusted predicted and immediate torque requests will be achieved. The actuation module 224 may be engine type specific. For example, the actuation module 224 may be implemented differently or use different control schemes for spark-ignition engines versus compression-ignition engines.

In various implementations, the actuation module 224 may define a boundary between modules that are common across all engine types and modules that are engine type specific. For example, engine types may include spark-ignition and compression-ignition. Modules prior to the actuation module 224, such as the propulsion torque arbitration module 206, may be common across engine types, while the actuation module 224 and subsequent modules may be engine type specific.

For example, in a spark-ignition engine, the actuation module 224 may vary the opening of the throttle valve 112 as a slow actuator that allows for a wide range of torque control. The actuation module 224 may disable cylinders using the cylinder actuator module 120, which also provides for a wide range of torque control but may also be slow and may involve drivability and emissions concerns. The actuation module 224 may use spark timing as a fast actuator. However, spark timing may not provide as much range of torque control. In addition, the amount of torque control possible with changes in spark timing (referred to as spark reserve capacity) may vary as air flow changes.

In various implementations, the actuation module 224 may generate an air torque request based on the adjusted predicted torque request. The air torque request may be equal to the adjusted predicted torque request, setting air flow so that the adjusted predicted torque request can be achieved by changes to other actuators.

An air control module 228 may determine desired actuator values based on the air torque request. For example, the air control module 228 may control desired manifold absolute pressure (MAP), desired throttle area, and/or desired air per cylinder (APC). Desired MAP may be used to determine desired boost, and desired APC may be used to determine desired cam phaser positions. In various implementations, the air control module 228 may also determine an amount of opening of the EGR valve 170.

The actuation module 224 may also generate a spark torque request, a cylinder shut-off torque request, and a fuel torque request. The spark torque request may be used by a spark control module 232 to determine how much to retard the spark timing (which reduces engine output torque) from a calibrated spark advance.

The cylinder shut-off torque request may be used by a cylinder control module 236 to determine how many cylinders to deactivate. The cylinder control module 236 may instruct the cylinder actuator module 120 to deactivate one or more cylinders of the engine 102. In various implementations, a predefined group of cylinders may be deactivated jointly.

The cylinder control module 236 may also instruct a fuel control module 240 to stop providing fuel for deactivated cylinders and may instruct the spark control module 232 to stop providing spark for deactivated cylinders. In various implementations, the spark control module 232 only stops providing spark for a cylinder once any fuel/air mixture already present in the cylinder has been combusted.

In various implementations, the cylinder actuator module 120 may include a hydraulic system that selectively decouples intake and/or exhaust valves from the corresponding camshafts for one or more cylinders in order to deactivate those cylinders. For example only, valves for half of the cylinders are either hydraulically coupled or decoupled as a group by the cylinder actuator module 120. In various implementations, cylinders may be deactivated simply by halting provision of fuel to those cylinders without stopping the opening and closing of the intake and exhaust valves. In such implementations, the cylinder actuator module 120 may be omitted.

The fuel control module 240 may vary the amount of fuel provided to each cylinder based on the fuel torque request from the actuation module 224. During normal operation of a spark-ignition engine, the fuel control module 240 may operate in an air lead mode in which the fuel control module 240 attempts to maintain a stoichiometric air/fuel ratio by controlling fuel flow based on air flow. The fuel control module 240 may determine a fuel mass that will yield stoichiometric combustion when combined with the current amount of air per cylinder. The fuel control module 240 may instruct the fuel actuator module 124 via the fueling rate to inject this fuel mass for each activated cylinder.

In compression-ignition systems, the fuel control module 240 may operate in a fuel lead mode in which the fuel control module 240 determines a fuel mass for each cylinder that satisfies the fuel torque request while minimizing emissions, noise, and fuel consumption. In the fuel lead mode, air flow is controlled based on fuel flow and may be controlled to yield a lean air/fuel ratio. In addition, the air/fuel ratio may be maintained above a predetermined level, which may prevent black smoke production in dynamic engine operating conditions.

A mode setting may determine how the actuation module 224 treats the adjusted immediate torque request. The mode setting may be provided to the actuation module 224, such as by the propulsion torque arbitration module 206, and may select modes including an inactive mode, a pleasible mode, a maximum range mode, and an auto actuation mode.

In the inactive mode, the actuation module 224 may ignore the adjusted immediate torque request and set engine output torque based on the adjusted predicted torque request. The actuation module 224 may therefore set the spark torque request, the cylinder shut-off torque request, and the fuel torque request to the adjusted predicted torque request, which maximizes engine output torque for the current engine air flow conditions. Alternatively, the actuation module 224 may set these requests to predetermined (such as out-of-range high) values to disable torque reductions from retarding spark, deactivating cylinders, or reducing the fuel/air ratio.

In the pleasible mode, the actuation module 224 outputs the adjusted predicted torque request as the air torque request and attempts to achieve the adjusted immediate torque request by adjusting only spark advance. The actuation module 224 therefore outputs the adjusted immediate torque request as the spark torque request. The spark control module 232 will retard the spark as much as possible to attempt to achieve the spark torque request. If the desired torque reduction is greater than the spark reserve capacity (the amount of torque reduction achievable by spark retard), the torque reduction may not be achieved. The engine output torque will then be greater than the adjusted immediate torque request.

In the maximum range mode, the actuation module 224 may output the adjusted predicted torque request as the air torque request and the adjusted immediate torque request as the spark torque request. In addition, the actuation module 224 may decrease the cylinder shut-off torque request (thereby deactivating cylinders) when reducing spark advance alone is unable to achieve the adjusted immediate torque request.

In the auto actuation mode, the actuation module 224 may decrease the air torque request based on the adjusted immediate torque request. In various implementations, the air torque request may be reduced only so far as is necessary to allow the spark control module 232 to achieve the adjusted immediate torque request by adjusting spark advance. Therefore, in auto actuation mode, the adjusted immediate torque request is achieved while adjusting the air torque request as little as possible. In other words, the use of relatively slowly-responding throttle valve opening is minimized by reducing the quickly-responding spark advance as much as possible. This allows the engine 102 to return to producing the adjusted predicted torque request as quickly as possible.

A torque estimation module 244 may estimate torque output of the engine 102. This estimated torque may be used by the air control module 228 to perform closed-loop control of engine air flow parameters, such as throttle area, MAP, and phaser positions. For example, a torque relationship such as $$T=f(\mathrm{APC},S,I,E,\mathrm{AF},\mathrm{OT},\#) \quad (1)$$

may be defined, where torque (T) is a function of air per cylinder (APC), spark advance (S), intake cam phaser position (I), exhaust cam phaser position (E), air/fuel ratio (AF), oil temperature (OT), and number of activated cylinders (#). Additional variables may also be accounted for, such as the degree of opening of an exhaust gas recirculation (EGR) valve.

This relationship may be modeled by an equation and/or may be stored as a lookup table. The torque estimation module 244 may determine APC based on the measured MAF and the actual engine speed, thereby allowing closed loop air control based on actual air flow. The intake and exhaust cam phaser positions used may be based on actual positions, as the phasers may be traveling toward desired positions.

The actual spark advance may be used to estimate the actual engine output torque. When a calibrated spark advance value is used to estimate torque, the estimated torque may be called an estimated air torque, or simply air torque. The air torque is an estimate of how much torque the engine could generate at the current air flow if spark retard was removed (i.e., spark timing was set to the calibrated spark advance value) and all cylinders were fueled.

The air control module 228 may output a desired throttle area to the throttle actuator module 116. The throttle actuator module 116 then regulates the throttle valve 112 to produce the desired throttle area. The air control module 228 may determine the desired throttle area based on an inverse torque model and the air torque request. The air control module 228 may use the estimated air torque and/or the MAF signal in order to perform closed loop control. For example, the desired throttle area may be controlled to minimize a difference between the estimated air torque and the air torque request.

The air control module 228 may output a desired manifold absolute pressure (MAP) signal to a boost scheduling module 248. The boost scheduling module 248 uses the desired MAP signal to control the boost actuator module 164. The boost actuator module 164 then controls one or more turbochargers (e.g., the turbocharger including the turbine 160-1 and the compressor 160-2) and/or superchargers.

The air control module 228 may also output a desired air per cylinder (APC) signal to a phaser scheduling module 252. Based on the desired APC signal and the actual engine speed, the phaser scheduling module 252 may control positions of the intake and/or exhaust cam phasers 148 and 150 using the phaser actuator module 158.

Referring back to the spark control module 232, calibrated spark advance values may vary based on various engine operating conditions. For example only, a torque relationship may be inverted to solve for desired spark advance. For a given torque request ($T_{des}$), the desired spark advance ($S_{des}$) may be determined based on $$S_{des}=f(T_{des},\mathrm{APC},I,E,\mathrm{AF},\mathrm{OT},\#) \quad (2)$$

This relationship may be embodied as an equation and/or as a lookup table. The air/fuel ratio may be the actual air/fuel ratio, as reported by the fuel control module 240.

When the spark advance is set to the calibrated spark advance, the resulting torque may be as close to mean best torque (MBT) as possible. MBT refers to the maximum engine output torque that is generated for a given air flow as spark advance is increased, while using fuel having an octane rating greater than a predetermined threshold and using stoichiometric fueling. The spark advance at which this maximum torque occurs is referred to as MBT spark. The calibrated spark advance may differ slightly from MBT spark because of, for example, fuel quality (such as when lower octane fuel is used) and environmental factors. The torque at the calibrated spark advance may therefore be less than MBT.

Figure 3:
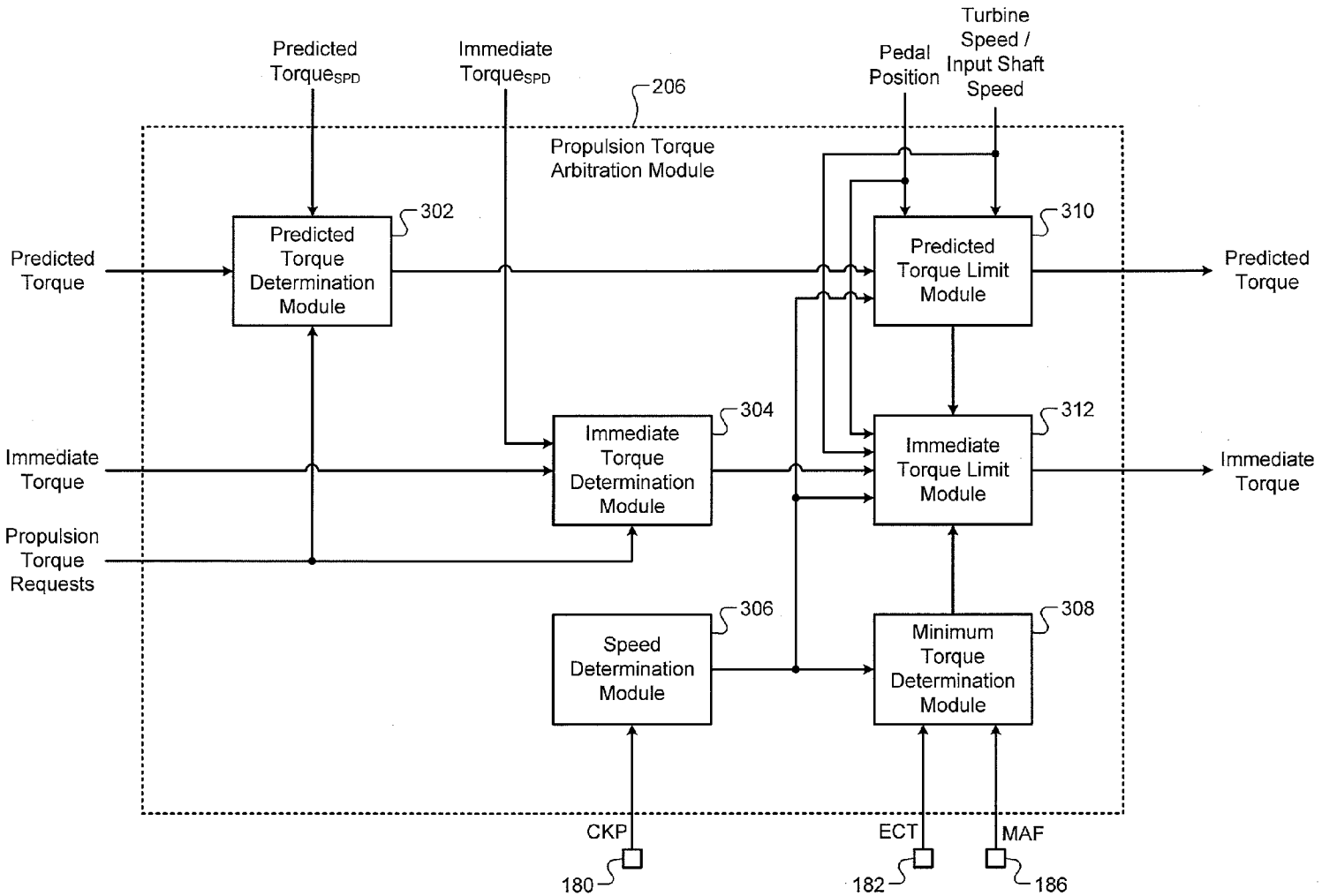
FIG. 3 is a functional block diagram of an example control module according to the principles of the present disclosure.

Referring now to FIG. 3, the propulsion torque arbitration module 206 may include a predicted torque determination module 302 and an immediate torque determination module 304. The predicted torque determination module 302 and the immediate torque determination module 304 determine a predicted torque request and an immediate torque request, respectively. The torque determination modules 302, 304 may determine the predicted and immediate torque requests by arbitrating between various propulsion torque requests. The propulsion torque requests may include those converted from axle torque requests output by the axle torque arbitration module 204, those from the speed control module 210, and other propulsion torque requests, as discussed above with reference to FIG. 2. The torque determination modules 302, 304 output the predicted and immediate torque requests.

A speed determination module 306 determines the actual speed of the engine 102 based on the crankshaft position from the CKP sensor 180. For example, the speed determination module 306 may calculate the engine speed based on a period that elapses as the crankshaft completes one or more revolutions. The speed determination module 306 outputs the engine speed. The speed determination module 306 may also determine engine acceleration (i.e., the rate of change of engine speed) and output the engine acceleration.

A minimum torque determination module 308 determines a minimum torque that prevents the engine 102 from stalling. The minimum torque may be a minimum amount of torque that can be produced by the engine 102 with minimal spark advance while keeping the engine 102 running and maintaining stable combustion. The minimum torque determination module 308 may determine the minimum torque based on the actual speed of the engine 102 and the mass flow rate of intake air from the MAF sensor 186 using, for example, a lookup table. Other engine operating conditions that may be used to determine the minimum torque include those that affect the combustibility of fuel such as the engine coolant temperature from the ECT sensor 182. The minimum torque determination module 308 outputs the minimum torque.

A predicted torque limit module 310 and an immediate torque limit module 312 selectively limit the predicted torque request and the immediate torque request, respectively, which are output by the torque determination modules 302, 304. The predicted torque limit module 310 module may limit the predicted torque request when a driver tips into an accelerator pedal (i.e., depresses an accelerator pedal from a released position). The predicted torque limit module 310 module may limit the predicted torque request when the percentage of pedal depression is greater than a threshold (e.g., 0 percent) and/or when the period of pedal depression is less than a threshold (e.g., 0.6 seconds). The predicted torque limit module 310 may determine the percentage and period of pedal depression based on pedal position, which may be received from the driver input module 104 of FIG. 1.

The immediate torque limit module 312 may not limit the immediate torque request when the predicted torque limit module 310 limits the predicted torque request until other conditions are satisfied, indicating that driveline bump is likely to occur. Driveline bump may be likely to occur when the engine speed continues to increase despite limiting the predicted torque request. When the predicted torque request is limited but the immediate torque request is not limited, the operating mode of the ECM 114 may be referred to as an enabled mode.

The immediate torque limit module 312 may limit the immediate torque request after a tip-in when the engine acceleration is greater than an acceleration threshold (e.g., 400 rpm/second) and slip is within slip thresholds. For an automatic transmission, slip is the difference between the engine speed and a turbine speed. For a manual transmission, slip is the difference between the engine speed and a transmission input shaft speed. The immediate torque limit module 312 may receive the turbine speed and/or the transmission input shaft speed from the TCM 194 of FIG. 1. When the immediate torque limit module 312 initially limits the immediate torque request, the operating mode of the ECM 114 may be referred to as an activated mode.

The slip thresholds may include a minimum threshold (e.g., 60 rpm) and a maximum threshold (e.g., 500 rpm). The slip may be within the slip thresholds when the slip is greater than the minimum threshold, indicating a potential for driveline bump, and less than the maximum threshold. When the slip is greater than the maximum threshold, the driver may be executing an aggressive maneuver, in which case it may be undesirable to interfere with the driver torque request.

When operating in the activated mode, the torque limits modules 310, 312 may decrease the predicted and immediate torque requests and then increase the predicted and immediate torque requests in a manner that prevents driveline bump. The predicted torque limit module 310 may initially set the predicted torque request to the estimated torque determined using relationship (1), discussed above with reference to FIG. 2. The estimated torque may be less than the driver torque request.

After setting the predicted torque request to the estimated torque, the predicted torque limit module 310 may increase the predicted torque request by a predetermined rate. For example, the predicted torque limit module 310 may increase the predicted torque request by 5 Newton-meters (Nm) every 12.5 milliseconds (ms). The predicted torque limit module 310 may increase the predicted torque request by the predetermined rate until the ECM 114 is no longer operating in the activated mode.

When operating in the activated mode, the immediate torque limit module 312 may limit the immediate torque request based on the minimum torque. For example, the immediate torque limit module 312 may set the immediate torque request equal to the sum of the minimum torque and a torque offset. Adjusting the immediate torque request in this manner ensures that the immediate torque request increases as the minimum torque increases. The torque offset may be determined based on a current transmission gear and a desired engine speed using, for example, a lookup table.

The ECM 114 may operate in the activated mode for a predetermined period (e.g., 100 ms). When the predetermined period expires, the torque limit modules 310, 312 may increase the predicted and immediate torque requests based on the driver torque request. The predicted torque limit module 310 may increase the predicted torque request to the driver torque request. The immediate torque limit module 312 may increase the immediate torque request to the driver torque request minus a torque reserve. The torque limit modules 310, 312 may increase the predicted and immediate torque requests in a nonlinear manner. When the torque limit modules 310, 312 increase the predicted and immediate torque requests based on the driver torque request, the operating mode of the ECM 114 may be referred to as a disabled mode.

When operating in the disabled mode, the torque limit modules 310, 312 may increase the predicted and immediate torque requests in a nonlinear manner. The immediate torque limit module 312 may initially increase the immediate torque request at a first rate and then increase the immediate torque request at a second rate that is less than the first rate. The immediate torque request may be increase quickly at first to ensure that the driver does not feel a hesitation or lag in the throttle response. However, the immediate torque request may be increase slowly as the immediate torque request approaches the driver torque request to prevent driveline bump.

The immediate torque limit module 312 may set the immediate torque request equal to the driver torque request minus the torque reserve. To ensure that the immediate torque request is increased by a predetermined torque increment (e.g., 0.5 Nm), the immediate torque limit module 312 may determine the immediate torque request using the following relationship:

$$(T_{im})_{prs}=\text{maximum}(T_{drv}-T_{rsv},(T_{im})_{prv}+\Delta T) \quad (3)$$

where $(T_{im})_{prs}$ is a present immediate torque request, $T_{drv}$ is the driver torque request, and $T_{rsv}$ is the torque reserve, $(T_{im})_{prv}$ is a previous immediate torque request, and $\Delta T$ is the predetermined torque increment.

The immediate torque limit module 312 may increase the immediate torque request by decreasing the torque reserve. The immediate torque limit module 312 may exponentially decrease the rate at which the immediate torque request is increased by exponentially decreasing the rate at which the torque reserve is decreased. When the disabled mode is first entered, the torque reserve may be set to the driver torque request minus the present immediate torque request. Subsequently, the torque reserve may be decreased by determining the torque reserve using the following equation:

$$(T_{rsv})_{prs}=(T_{rsv})_{prv}-((T_{rsv})_{prv}*K) \quad (4)$$

where $(T_{rsv})_{prs}$ is a present torque reserve, $(T_{rsv})_{prs}$ is a previous torque reserve, and K is a predetermined rate (e.g., between 0 and 1). To ensure that the torque reserve is decreased to zero, the torque reserve may be decreased by a predetermined amount (e.g., 0.25 Nm) when the immediate torque request is within a predetermined range (e.g., 4 Nm) of the driver torque request.

The predicted torque limit module 310 may initially increase the predicted torque request at a first rate and then increase the immediate torque request at a second rate that is greater than the first rate. When the disabled mode is first entered, the predicted torque request may be much greater than the immediate torque request due to torque limiting. Thus, the predicted torque request may be increased slowly at first since the predicted torque request may have little to no effect on the actual torque output of the engine 102. However, as the immediate torque request approaches the driver torque request, the predicted torque request may be increased quickly to ensure that the predicted torque request does not interfere with the immediate torque request.

The predicted torque limit module 310 may exponentially increase the rate at which the predicted torque request is increased by determining the predicted torque request using the following equation:

$$(T_{prd})_{prs}=(T_{prd})_{prv}+\Delta T \quad (5)$$

where $(T_{prd})_{prs}$ is a present predicted torque request, $(T_{prd})_{prv}$ is a previous predicted torque request, and ΔT is a torque increment.

The predicted torque limit module 310 may exponentially increase the torque increment by determining the torque increment using the following relationship:

$$(\Delta T)_{prs}=(\Delta T)_{prv}+(\Delta T)_{inc} \quad (6)$$

where $(\Delta T)_{prs}$ is a present torque increment, $(\Delta T)_{prv}$ is a previous torque increment, and $(\Delta T)_{inc}$ is a torque increment increase. The torque increment increase may be determined through calibration and may be fixed or vary as the predicted torque request is increased.

In some cases, driveline bump may still occur as the predicted and immediate torque requests are increased in the disabled mode. Thus, the torque limit modules 310, 312 may limit the predicted and immediate torque requests for a second time to prevent driveline bump and engine speed flare. When the torque limit modules 310, 312 limit the predicted and immediate torque requests for a second time, the operating mode of the ECM 114 may be referred to as a retriggered state of the activated mode.

The torque limit modules 310, 312 may limit the predicted and immediate torque requests for a second time when one or more conditions are satisfied. A first condition may be satisfied when the slip is greater than a slip threshold (e.g., 50 rpm). A second condition may be satisfied when the immediate torque is greater than or equal to a predetermined percentage (e.g., 50 percent) of the driver torque request. A third condition may be satisfied when the immediate torque request is increased in the disabled mode. A fourth condition may be satisfied when the ECM 114 has not yet entered the retriggered state of the activated mode during a present tip-in. A fifth condition may be satisfied when the transmission is either a manual transmission or an automatic transmission with a torque converter clutch in a controlled slip or locked.

When operating in the retriggered state of the activated mode, the torque limits modules 310, 312 may decrease the predicted and immediate torque requests and then increase the predicted and immediate torque requests in a manner that prevents driveline bump. The predicted torque limit module 310 may limit the predicted torque request in the same way that the predicted torque limit module 310 limits the predicted torque request when the activated mode is first entered. The immediate torque limit module 312 may limit the immediate torque request based on the minimum torque similar to when the activated mode is first entered. However, the immediate torque limit module 312 may limit the immediate torque request based on the minimum torque in a different way when the retriggered state of the activated mode is entered.

When the retriggered state of the activated mode is entered, the immediate torque limit module 312 may decrease the immediate torque request to a torque level that is greater than the minimum torque. The relationship between the torque level and the minimum torque may be predetermined through calibration to ensure that the immediate torque request increases as the minimum torque increases.

Initially, the immediate torque limit module 312 may decrease the immediate torque request by a predetermined percentage (e.g., 50 percent) of a difference between the previous immediate torque request and the minimum torque. The immediate torque limit module 312 may ensure that this initial immediate torque request is greater than an average of the previous immediate torque request and the last immediate torque request determined when the activated mode is first entered. In turn, the immediate torque request is decreased, but not to the degree that it is decreased when the activated mode is first entered to prevent noticeable acceleration delay.

For the remainder of operation in the retriggered state of the activated mode, the immediate torque limit module 312 may determine the immediate torque request based on the initial immediate torque request using the following equation:

$$(T_{im})_{prs}=(T_{im})_{int}-\%*((T_{im})_{int}-T_{min}) \quad (7)$$

where $(T_{im})_{prs}$ is the present immediate torque request, $(T_{im})_{int}$ is the initial immediate torque request, % is the predetermined percentage, and $T_{min}$ is the minimum torque. Determining the immediate torque request using equation (7) ensures that the immediate torque request increases as the minimum torque increases. Additionally, when operating in the retriggered state of the activated mode, the immediate torque limit module 312 may ensure that the immediate torque request does not decrease.

The ECM 114 may operate in the retriggered state of the activated mode for a predetermined period (e.g., 50 to 60 ms). When the predetermined period expires, the disabled mode may be entered for a second time and the torque limit modules 310, 312 may increase the predicted and immediate torque requests based on the driver torque request. The torque limit modules 310, 312 may increase the predicted and immediate torque requests in the same way that the torque limit modules 310, 312 increase the predicted and immediate torque requests when the disabled mode is first entered.

As discussed above with reference to FIG. 2, one or more (e.g., all) cylinders of the engine 102 may be deactivated and fuel provision to deactivated cylinders may be stopped. Cylinders may be deactivated during a vehicle deceleration to improve fuel economy. When the ECM 114 deactivates cylinders during a vehicle deceleration, the operating mode of the ECM 114 may be referred to as a deceleration fuel cutoff mode.

When the driver tips into the accelerator pedal while the ECM 114 is operating in the enabled, activated, or disabled modes, the immediate torque limit module 312 determines a first torque limit that prevents driveline bump and acceleration delay. The first torque limit may be the immediate torque request that is determined by the immediate torque limit module 312 as discussed above. When the first torque limit is less than the immediate torque request that is output by the immediate torque determination module 304, the immediate torque limit module 312 may limit the immediate torque request to the first torque limit.

When the driver tips into the accelerator pedal while the ECM 114 is operating in the deceleration fuel cutoff mode, the immediate torque limit module 312 may determine a second torque limit that transitions the engine torque to the driver torque request. The second torque limit may be determined in a way that prevents a sudden increase or jerk in vehicle acceleration as the engine torque is increased from a torque level when fuel provision to deactivated cylinders is stopped to the driver torque request. When the second torque limit is less than the immediate torque request that is output by the immediate torque determination module 304, the immediate torque limit module 312 may limit the immediate torque request to the second torque limit.

To avoid a conflict between the first torque limit and the second torque limit, the immediate torque limit module 312 may set the immediate torque request to a minimum of the first torque limit and the second torque limit. Limiting the immediate torque request in this manner when the driver tips into the accelerator pedal prevents driveline bump, a delay in vehicle acceleration, and a sudden increase in vehicle acceleration.

Figure 4:
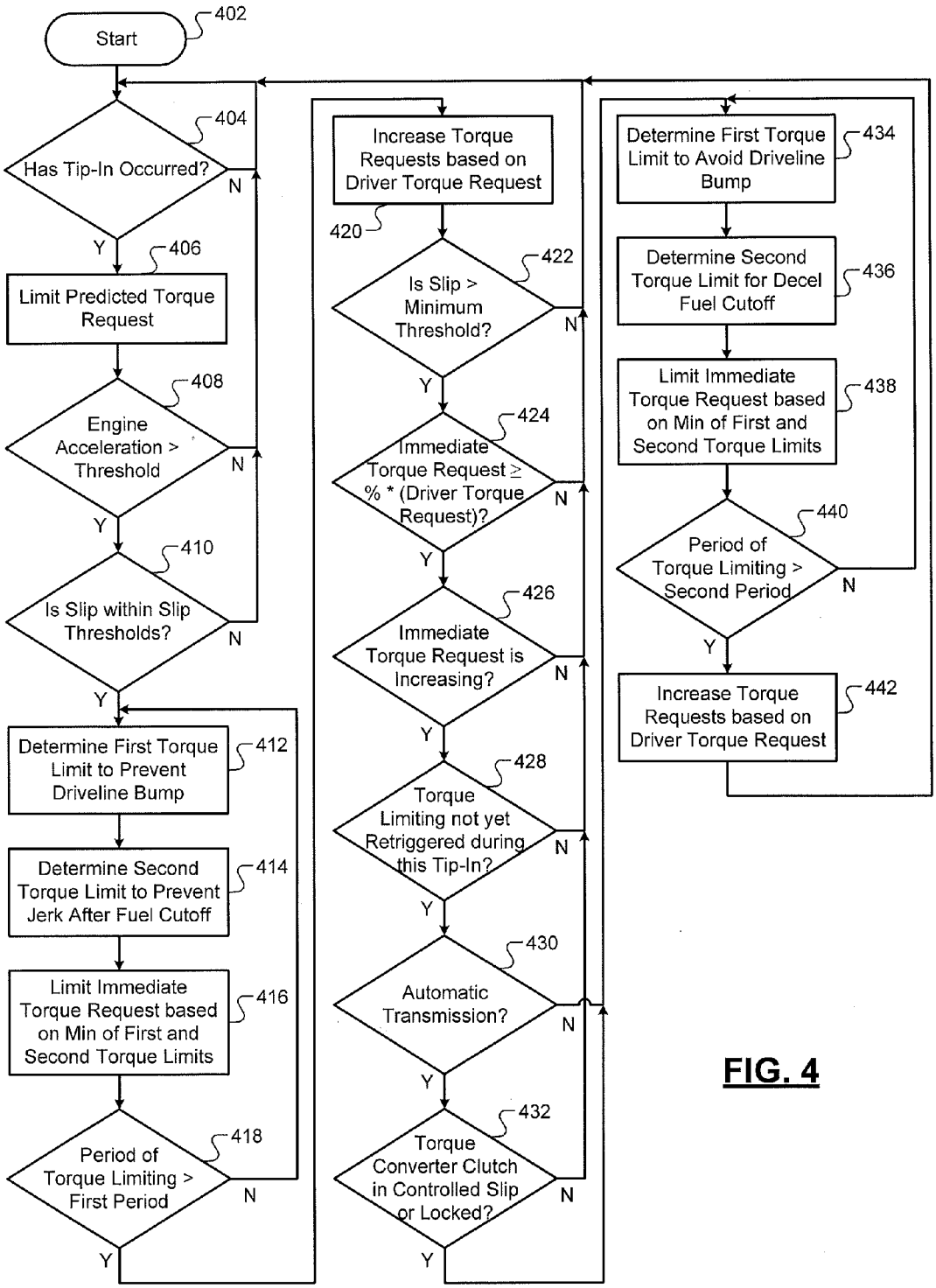
FIG. 4 is a flowchart illustrating an example engine control method according to the principles of the present disclosure.

Referring now to FIG. 4, a method of controlling engine torque to prevent driveline bump when a driver tips into an accelerator pedal begins at 402. At 404, the method determines whether a tip-in has occurred. A tip-in occurs when the driver depresses the accelerator pedal from a released position. The method may determine that a tip-in has occurred when the percentage of pedal depression is greater than a threshold (e.g., 0 percent) and/or when the period of pedal depression is less than a threshold (e.g., 0.6 seconds). If a tip-in has occurred, the method continues to 406.

At 406, the method limits a predicted torque request. The method may adjust slow actuators (e.g., a throttle valve) based on the predicted torque request. The method may limit the predicted torque request by setting the predicted torque request to the estimated torque determined using relationship (1), discussed above with reference to FIG. 2. The method may limit the predicted torque request for a predetermined period and then increase the predicted torque request to a driver torque request. The driver torque request may be determined based on the position of the accelerator pedal.

At 408, the method determines whether engine acceleration is greater than a threshold. If the engine acceleration is greater than the threshold, the method continues to 410. Otherwise, the method returns to 404. At 410, the method determines whether slip is within slip thresholds. For an automatic transmission, slip is the difference between the engine speed and a turbine speed. For a manual transmission, slip is the difference between the engine speed and a transmission input shaft speed. The slip is within the slip thresholds when the slip is greater than a first minimum threshold (e.g., 60 rpm) and less than a maximum threshold (e.g., 500 rpm). If the slip is within the slip thresholds, the method continues at 412. Otherwise, the method returns to 404.

At 412, the method determines a first torque limit to prevent driveline bump without causing a delay in vehicle acceleration. At 414, the method determines a second torque limit to prevent a jerk in vehicle acceleration after fuel provision to one or more cylinders of an engine is stopped. At 416, the method limits an immediate torque request to a minimum of the first torque limit and the second torque limit. The method may adjust fast actuators (e.g., a fuel injector) based on the immediate torque request.

The first torque limit may include a predicted torque limit and an immediate torque limit. The method may limit the predicted torque request based on the predicted torque limit and limit the immediate torque request based on the immediate torque limit. The method may limit the predicted and immediate torque requests at 416 in the same way that the torque limit modules 310, 312 of FIG. 3 limit the predicted and immediate torque requests when operating in the activated mode. Thus, the immediate torque limit may be determined based on a minimum torque that prevents the engine from stalling.

At 418, the method determines whether the immediate torque request has been limited for a period that is greater than a first period (e.g., 100 ms). The first period may be predetermined. When the period torque limiting is greater than the first period, the method continues to 420. Otherwise, the method returns to 412.

At 420, the method increases the predicted and immediate torque requests based on the driver torque request. The method may increase the predicted and immediate torque requests at 420 in the same way that the torque limit modules 310, 312 increase the predicted and immediate torque requests when operating in the disabled mode. The method may limit the immediate torque request to a minimum of the first torque limit and the second torque limit while increasing the immediate torque request based on the driver torque request.

At 422, the method determines whether the slip is greater than a second minimum threshold (e.g., 50 rpm). The second minimum threshold may be predetermined. If the slip is greater than the second minimum threshold, the method continues at 424. Otherwise, the method returns to 404.

At 424, the method determines whether the immediate torque request is greater than or equal to a product of a predetermined percentage (e.g., 50 percent) and the driver torque request. If the immediate torque request is greater than or equal to the product, the method continues at 426. Otherwise, the method returns to 404.

At 426, the method determines whether the immediate torque request is increasing. When the immediate torque request is increasing, the method continues to 428. Otherwise, the method returns to 404. At 428, the method determines whether limiting the immediate torque request has been retriggered during a present tip-in. When limiting the immediate torque request has not yet been retriggered, the method continues to 430. Otherwise, the method returns to 404.

At 430, the method determines whether a vehicle is equipped with an automatic transmission or a manual transmission. If the vehicle is equipped with an automatic transmission, the method continues to 432. Otherwise, the method continues at 434. At 432, the method determines whether a torque converter clutch that couples the automatic transmission to the engine is in a controlled slip or locked. If the torque converter clutch is in a controlled slip or locked, the method continues to 434. Otherwise, the method returns to 404.

At 434, the method determines a first torque limit to prevent driveline bump without causing a delay in vehicle acceleration. At 436, the method determines a second torque limit to prevent a jerk in vehicle acceleration after fuel provision to one or more cylinders of an engine is stopped. At 438, the method limits the immediate torque request to a minimum of the first torque limit and the second torque limit.

The first torque limit may include a predicted torque limit and an immediate torque limit. The method may limit the predicted torque request based on the predicted torque limit and limit the immediate torque request based on the immediate torque limit. The method may limit the predicted and immediate torque requests at 438 in the same way that the torque limit modules 310, 312 of FIG. 3 limit the predicted and immediate torque requests when operating in the retriggered state of the activated mode.

At 440, the method determines whether the immediate torque request has been limited for a period that is greater than a first period (e.g., 50 to 60 ms). The first period may be predetermined. When the period torque limiting is greater than the first period, the method continues to 442. Otherwise, the method returns to 434.

At 442, the method increases the predicted and immediate torque requests based on the driver torque request. The method may increase the predicted and immediate torque requests at 442 in the same way that the torque limit modules 310, 312 increase the predicted and immediate torque requests when operating in the disabled mode. The method may limit the immediate torque request to a minimum of the first torque limit and the second torque limit while increasing the immediate torque request based on the driver torque request. The method returns to 404 when the predicted and immediate torque requests have been increased to target torque levels.

Figure 5:
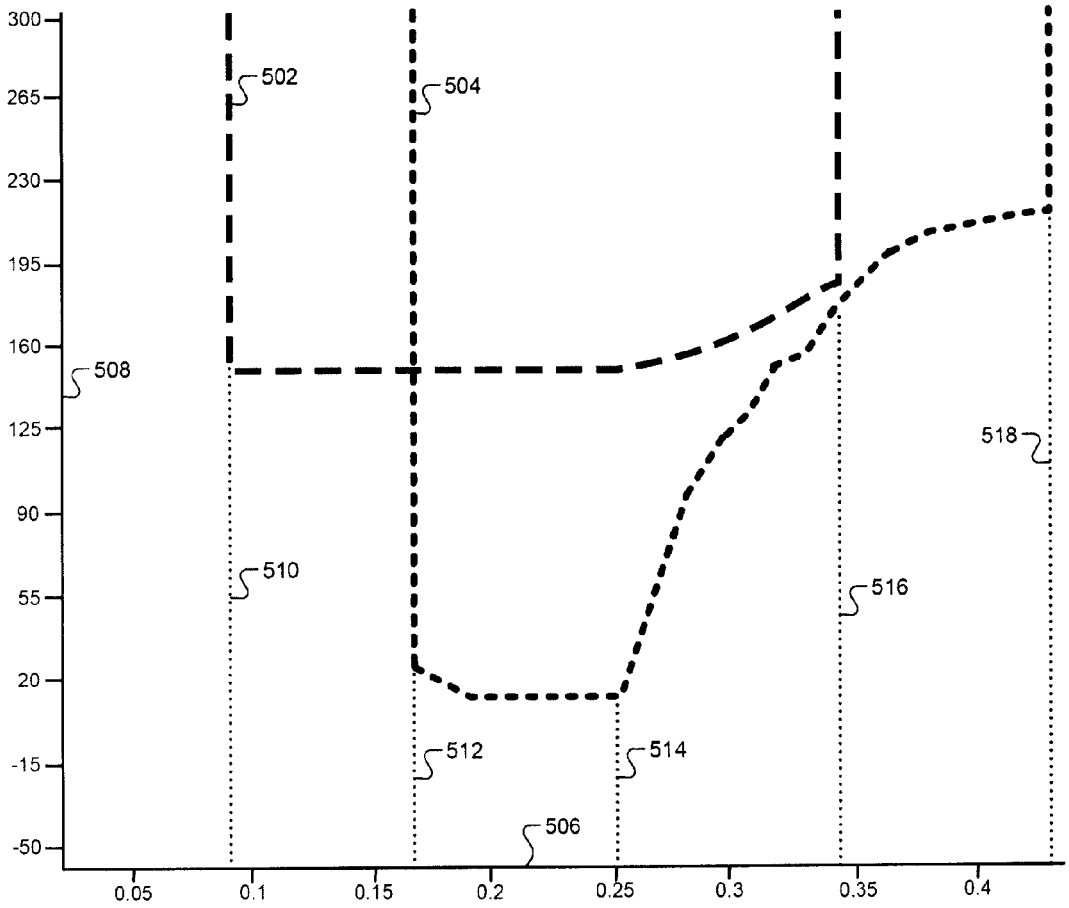
FIG. 5 is a graph illustrating example torque requests as limited according to the principles of the present disclosure.

Referring now to FIG. 5, a predicted torque limit 502 and an immediate torque limit 504 are illustrated. The predicted torque limit 502 and the immediate torque limit 504 limit a predicted torque request and an immediate torque request, respectively. The predicted and immediate torque limits 502, 504 are plotted with respect to an x-axis 506 that represents time in seconds and a y-axis 508 that represents torque in Nm.

At a time 510, the predicted torque limit 502 is decreased to limit the predicted torque request in response to a tip-in. At a time 512, the immediate torque limit 504 is decreased to limit the immediate torque request in response to a difference between engine speed and a turbine speed or a transmission input shaft speed. The period between the times 510, 512 corresponds to operation in the enabled mode.

At a time 514, the predicted and immediate torque limits 502, 504 are increased based on a driver torque request. The period between the times 512, 514 corresponds to operation in the activated mode. At a time 516, the predicted torque limit 502 reaches its target and therefore is increased to stop limiting the predicted torque request. At a time 518, the immediate torque limit 504 reaches its target and therefore is increased to stop limiting the immediate torque request.

The period between the times 514, 518 corresponds to operation in the disabled mode. Thus, the predicted and immediate torque limits 502, 504 may be adjusted in the nonlinear manner during this period. The immediate torque limit 504 may be increased quickly at first to prevent acceleration delay and then slowly to prevent driveline bump. The predicted torque limit 502 may be increased slowly at first and then quickly as the predicted torque limit 502 approaches its target to avoid interfering with the immediate torque limit 504.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a torque determination module that determines a first torque that prevents an engine from stalling; and a torque limit module that controls engine torque based on a sum of the first torque and a torque offset when a driver actuates an accelerator pedal from a first position in which the accelerator pedal is not depressed to a second position in which the accelerator pedal is depressed.

2. The system of claim 1 wherein the torque limit module limits the engine torque for a first period when a first difference between engine speed and one of turbine speed and transmission input shaft speed is greater than a first threshold.

3. The system of claim 2 wherein, during the first period, the torque limit module limits the engine torque based on a sum of the first torque and a torque offset.

4. The system of claim 2 wherein the torque limit module adjusts the engine torque based on a driver torque request when the first period ends.

5. The system of claim 4 wherein the torque limit module limits the engine torque for a second period when the first difference is greater than a second threshold after the first period ends.

6. The system of claim 5 wherein, during the first period and the second period, the torque limit module limits the engine torque based on a minimum of a first torque limit that prevents driveline bump and a second torque limit that transitions the engine torque to the driver torque request after fuel provision to a cylinder of the engine is stopped.

7. The system of claim 5 wherein, during the second period, the torque limit module limits the engine torque based on a second difference between a previous torque request and the first torque.

8. A system comprising:

a torque determination module that determines a first torque that prevents an engine from stalling; and a torque limit module that:

limits engine torque based on the first torque when a driver actuates an accelerator pedal from a first position in which the accelerator pedal is not depressed to a second position in which the accelerator pedal is depressed;

limits the engine torque for a first period when a first difference between engine speed and one of turbine speed and transmission input shaft speed is greater than a first threshold;

adjusts the engine torque based on a driver torque request when the first period ends;

limits the engine torque for a second period when the first difference is greater than a second threshold after the first period ends;

limits the engine torque during the second period based on a second difference between a previous torque request and the first torque; and limits the engine torque based on a third difference between the previous torque request and a product of a predetermined percentage and the second difference during the second period.

9. The system of claim 8 wherein the torque limit module adjusts the engine torque based on the driver torque request when the second period ends.

10. The system of claim 9 wherein the torque limit module increases the engine torque in a nonlinear manner when the first period ends and when the second period ends.

11. A method comprising:

determining a first torque that prevents an engine from stalling; and controlling engine torque based on a sum of the first torque and a torque offset when a driver actuates an accelerator pedal from a first position in which the accelerator pedal is not depressed to a second position in which the accelerator pedal is depressed.

12. The method of claim 11 further comprising limiting the engine torque for a first period when a first difference between engine speed and one of turbine speed and transmission input shaft speed is greater than a first threshold.

13. The method of claim 12 further comprising limiting the engine torque during the first period based on a sum of the first torque and a torque offset.

14. The method of claim 12 further comprising adjusting the engine torque based on a driver torque request when the first period ends.

15. The method of claim 14 further comprising limiting the engine torque for a second period when the first difference is greater than a second threshold after the first period ends.

16. The method of claim 15 further comprising limiting the engine torque during the first period and the second period based on a minimum of a first torque limit that prevents driveline bump and a second torque limit that transitions the engine torque to the driver torque request after fuel provision to a cylinder of the engine is stopped.

17. The method of claim 15 further comprising limiting the engine torque during the second period based on a second difference between a previous torque request and the first torque.

18. A method comprising:

determining a first torque that prevents an engine from stalling;

limiting engine torque based on the first torque when a driver actuates an accelerator pedal from a first position in which the accelerator pedal is not depressed to a second position in which the accelerator pedal is depressed;

limiting the engine torque for a first period when a first difference between engine speed and one of turbine speed and transmission input shaft speed is greater than a first threshold;

adjusting the engine torque based on a driver torque request when the first period ends;

limiting the engine torque for a second period when the first difference is greater than a second threshold after the first period ends;

limiting the engine torque during the second period based on a second difference between a previous torque request and the first torque; and limiting the engine torque based on a third difference between the previous torque request and a product of a predetermined percentage and the second difference during the second period.

19. The method of claim 18 further comprising adjusting the engine torque based on the driver torque request when the second period ends.

20. The method of claim 19 further comprising increasing the engine torque in a nonlinear manner when the first period ends and when the second period ends.

* * * * *